United States Patent [19]

Meyer

[11] Patent Number: 4,894,096

[45] Date of Patent: Jan. 16, 1990

[54] PRODUCTS BASED ON ALUMINUM CONTAINING LITHIUM WHICH CAN BE USED IN THEIR RECRYSTALLIZED STATE AND A PROCESS FOR OBTAINING THEM

[75] Inventor: Philippe Meyer, Voiron, France

[73] Assignee: Cegedur Pechiney, Voreppe, France

[21] Appl. No.: 877,178

[22] Filed: Jun. 23, 1986

[30] Foreign Application Priority Data

Jun. 25, 1985 [FR] France ..... 85 10031

[51] Int. Cl.[4] ..... C22F 1/04

[52] U.S. Cl. ..... 148/2; 148/12.7 A; 148/415; 148/416; 148/417

[58] Field of Search ..... 148/437–440, 148/2, 3, 11.5 A, 12.7 A, 415–418; 420/529, 531, 532

[56] References Cited

U.S. PATENT DOCUMENTS 4,584,173 4/1986 Gray et al. ..... 420/532
4,588,553 5/1986 Evans et al. ..... 148/439

FOREIGN PATENT DOCUMENTS 107334 2/1984 European Pat. Off. .
61-56296 3/1986 Japan .
2126936 4/1984 United Kingdom .
8502416 6/1985 World Int. Prop. O. .

OTHER PUBLICATIONS

Sanders, Jr. et al., Materials Science and Engineering, 43 (1980), 247–260.

*Primary Examiner*—Richard O. Dean
*Attorney, Agent, or Firm*—Dennison, Meserole, Pollack & Scheiner

[57] ABSTRACT

The invention relates to aluminum alloy products containing 1 to 3.5% Li, up to 4% Cu, up to 5% Mg and up to 3% Zr, and additions of Mn, Cr and/or Zr, in which:

$$Zn \leqq 0.10\%,\ Mn \leqq 0.8\%, \text{ and } Cr \leqq 0.20\%,$$

$$\text{with } \frac{\%Zr}{0.03} + \frac{\%Mn}{0.3} + \frac{\%Cr}{0.07} > 1.$$

The alloy is recrystallized and has an average grain size of less than 200 μm.

6 Claims, 3 Drawing Sheets

0,4 mm 0,4
mm

PRODUCTS BASED ON ALUMINUM CONTAINING LITHIUM WHICH CAN BE USED IN THEIR RECRYSTALLIZED STATE AND A PROCESS FOR OBTAINING THEM

The invention concerns aluminium alloy products containing lithium which can be used in their recrystallized state and a process for obtaining them.

The problem facing the metallurgist is the problem of finding conditions in which aluminium-lithium alloys can be obtained, which alloys might contain other hardening elements such as copper, magnesium and zinc, as major additions, which can be used in their recrystallized state.

Indeed, the technical literature dealing with this area shows that the recrystallized state is ill-fated in terms of application properties, particularly concerning ductibility—see, for example, table III (tensile properties) in the article by Starke and Lin in Metallurgical Trans. A Vol. 13A, December, 1982. p. 2259–2269—which has led to:

- the replacement of Mn by Zr as the recrystallization inhibitor, which is more powerful than the former—see pages 4–7 and 4–8 of the article by Sanders, Naval Air Development Centre contract No. N62269-76-C0271 for Naval Air systems Command, Final Report, 14th June, 1979, or FIG. 12 page 1037 to 1042 by Starke, in Strength of Metals and Alloys—published by R. C. GIFKINS 1982, Vol. 3, p. 1025–1044;
- the use of special quenching and tempering treatments which are designed to inhibit recrystallization—see page 402 of the article by Lin and Chakrabotty, in Metallurgical Trans. A, Vol. 13A, March, 1982, p. 401–410;
- and, finally, the development of products which have not been crystallized—see FIG. 12, p. 376 and FIG. 17, p. 380 in the article by PEEL et al. Proceedings of the Al-Li Conference at Monterey, 1983. The Metallurgical Society of AIME.

The alloy based on aluminium, according to the invention, containing (in weight) between 1 and 3.5% lithium, up to 4% copper, up to 5% magnesium, up to 3% zinc and additions of manganese, chromium and/or zirconium, is characterised by manganese, chromium and/or zirconium content in the following quantities by weight:

$Zr \leqq 0.10\%$ $Mn \leqq 0.8\%$ $Cr \leqq 0.20\%$ with $\%Zr/0.03+\%Mn/0.3+\%Cr/0.07>1$ and, preferably, for $Zr \leqq 0.08\%$ $5Zr/0.4+QMn/0.5<1$ and, for $Zr \geqq 0.08\%$, $\%Zr/0.09+\%Mn/3.6<1$ with $Cr<0.15\%$ for $Zr \leqq 0.09\%$. and by a recrystallized structure the average grain size of which is less than or equal to 200 μm One method of obtaining the alloy according to the invention consists, on the one hand, of controlling the content of dispersoid elements (Mn, Zr, Cr) of the alloy and, on the other hand, of employing a final under-tempering of the latter, the other conditions of the production programme being the usual ones for products of this nature, especially for alloys with structural hardening which are used in aeronautics.

If the dispersoid content (Mn, Cr, Zr) exceeds the limits set above, the alloy is not recrystallized after hot or cold transformation in the usual conditions, and is annealed (or solution annealed).

If the dispersoid content level is lower than the limits shown above, the alloy recrystallizes after hot or cold transformation and is annealed (or solution annealed), but possesses a coarse grain, as a result (>200 μm).

The usual production programme of products of this kind includes:

- obtaining a product that has been improved by a semi-continuous technique of casting in ingots, plates or billets, or by the technique of powder metallurgy;
- possibly a stress-relieving at the temperatures to between 300° and 400° C.;
- possibly homogenizing below the solidus of the alloy, at temperatures that are generally between 500° and 555° C., whereby the temperature may previously have been maintained at a lower level for the purpose of resorbing the metastable phases which might be present;
- heat-shaping by rolling, forging, impact forging, extrusion or any other technique, at a temperature that is lower than or equal to 500° C., preferably between 470° C. and 200° C., up to the final or intermediate dimensions;
- if the product obtained is an intermediate product, the subsequent transformations are carried out cold with one or several intermediate annealing operations at temperatures of between 200° and 500° C. depending on the deformation applied and the nature of the alloy;
- the product that is a raw hot transformation product or that is obtained after cold transformation is then placed in solution at temperatures of between approximately 500° and 550° C., quenched in cold water ($\phi<30°$ C.) and tempered in special conditions, being the subject matter of the invention, after possibly the cold-stretching of the product between its quenching and its tempering.

The products which have been annealed or placed in solution have an average grain size, measured according to the standard, NF A 04-503, intersections method, of less than 200 μm.

The tempering process according to the invention is carried on in the following conditions:

- the tempering is conducted in the region of temperatures (T) of lower than or equal to the isothermal tempering temperature which brings about maximum hardening ($T_M$);
- the length of time during which an isothermal tempering is maintained, t(T), at the temperature, (T), is less than or equal to the length of time the isotherm, tm(T), is maintained, which brings about maximum hardening at that temperature, T. The optimum range of the temperings is defined by:

$T(°C)<T_M(°C)-15$ $t(T)<tm(T)/2.$

The invention can be better understood with the aid of the following examples which are illustrated by FIGS. 1 to 8.

EXAMPLE 1

Figure 1:
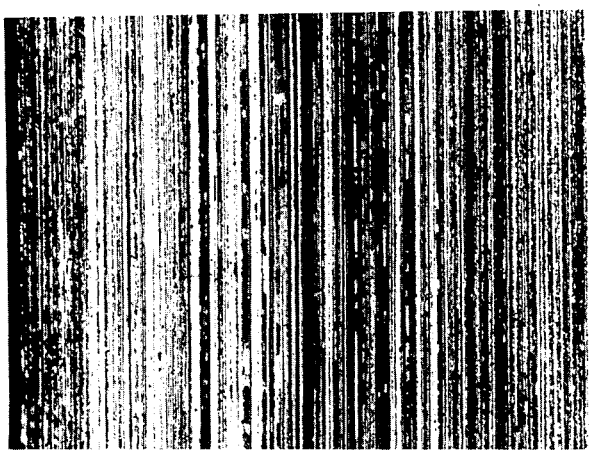
- FIG. 1 represents the microstructure of a alloy which has not been recrystallized (casting A, example 1).

The example concerns thin sheet metal made of Al-Li-Cu-Mg alloy, the Zr content of which is other than that of (or according to) the invention and the final tempering carried on according to conditions other than those of the invention (or according to those of the invention).

Two alloys of the following composition (% by weight):

A/ Li: 2.5—Cu: 1.30—Mg: 0.90—Zr: 0.12—Fe: 0.05—Si: 0.04

B/ Li: 2.5—Cu: 1.35—Mg: 0.90—Zr: 0.05—Fe: 0.05—Si: 0.05 remainder, Al, were semi-continuously cast in the shape of plates of $800\times300$ mm$^2$ in section and of 1200 kg each.

The plates were homogenised for 24 hours at 535° C., scalped to a section of $770\times270$ mm$^2$, reheated to 470° C. for 12 hours, and hot-rolled from 460° C. until they were 4.6 mm thick.

The strips as hot-rolled were annealed into coils while the temperature was maintained at 450° C. for 1 hour (rise and fall in temperature of the order of 25° C. per hour), cold-rolled until they were 3.2 mm thick, annealed again (as previously) and cold-rolled again until they were 2.3 mm thick.

The sheets that were obtained in this way were placed in solution in an air furnace: 20 mn at 533° C., quenched in cold water ($\theta<20°$ C.), flattened and drawn out by traction until they had been lengthened by 2% before undergoing various tempering processes, as is shown in table 1.

The mechanical traction characteristics in various directions, and the results bending and deep-drawing tests (the Erichsen test) are shown in Table 1.

Figure 3:
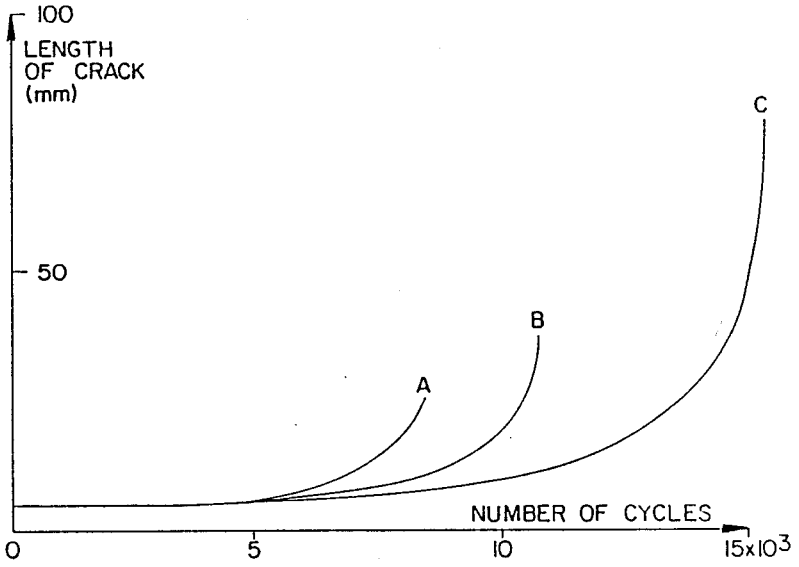
- FIG. 3 represents the development of the dimension of a fatique crack as a function of the number of cycles for three conditions of tempering on recrystallized alloy.
Figure 8:
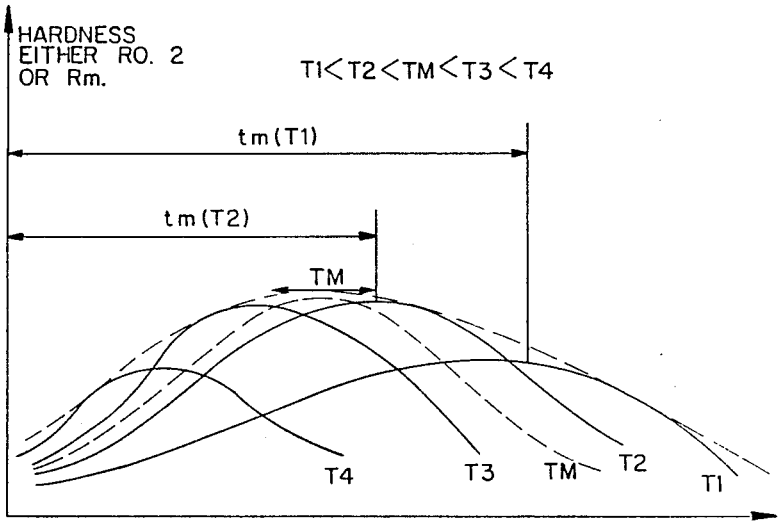
FIG. 8 represents the isothermal tempering curves diagrammatically and the definition of the parameters: t(T), tm(T), T, $T_M$.

FIG. 3 represents the development of the length of a fatigue crack in alloy B under sinusoidal stress with a maximum stress of 130 MPa, and a minimum stress of 50 MPa, at a frequency of 30 hertz, on a test piece with a central crack 160 mm wide and 2.3 mm thick, in 3 tempering states: A: 12 hours at 210° C.—B: 24 hours at 190° C.—C: 24 hours at 150° C. This example shows that only the combination of a low level of Zr content (0.05%) and an under-tempering (24 hours at 150° C.) makes it possible for a recrystallized product to be obtained which has good ductility and is relatively isotropic (A%>10%, bending radius ≃3e* and the Erichsen deflection >3 mm).

EXAMPLE 2

This example relates to a cold-drawn tube with high-level zirconium (not according to the invention) and a low-level zirconium (according to the invention).

Two alloys of the following composition (% by weight):

C/ Li: 2.60—Cu: 1.30—Mg: 1.05—Zr: 0.13—Fe: 0.04—Si: 0.02

D/ Li: 2.65—Cu: 1.35—Mg: 1.00—Zr: 0.08—Fe: 0.04—Si: 0.03

*'e'='thickness' the remainder being aluminium, were cast in semi-continuous casting in the form of billets $\phi$ 200 mm, weighing 150 kg each. The extrusion billets were scalped to $\phi$ 138 mm, extruded at 400° C. into a rough-pierced tube blank $\phi$ 50/40 mm, annealed at 450° C. for 1 hour, cooled with still air, cold-drawn by 100%, placed in solution at 535° C. for 1 hour 30 mn, quenched in cold water and tempered either for 24 hours at 190° C. (casting C, tempering not according to the invention), or for 24 hours at 170° C. (casting D, tempering according to the invention).

Figure 4:
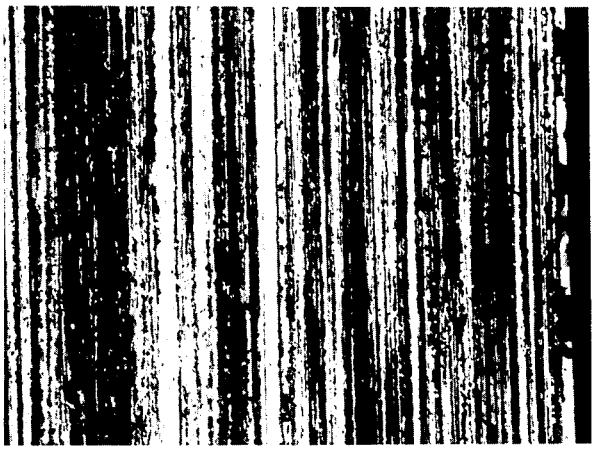
FIG. 4 represents the microstructure of an alloy which has not been recrystallized (casting C, example 2).
Figure 5:
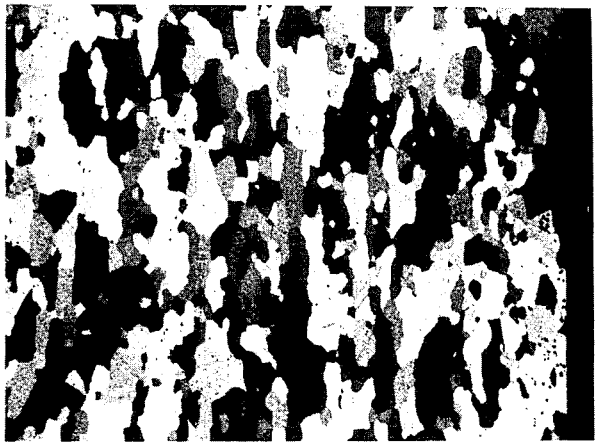
FIG. 5 represents the microstructure of a recrystallized alloy (casting D, example 2).

The mechanical characteristics in the rolling direction obtained on the tube of a thickness of 3 mm which was obtained in this way are the following:

| Casting | C | D |
|---|---|---|
| R 0.2 (MPa) | 485 | 465 |
| Rm (MPa) | 495 (brittle fracture) | 535 |
| A% of 5.65 $\sqrt{So}$ | 2 | 6.7 |
| Structure | not recrystallized (FIG. 4) | recrystallized (FIG. 5) |

EXAMPLE 3 (according to the invention)

An alloy containing (by weight) 2.00% Li—2.05% Cu—1.45% Mg—0.08% Zr—0.06% Fe—0.03% Si, the remainder being aluminium, was cast in semi-continuous casting in a plate with a section of $800\times300$ mm$^2$, weighing 1200 kg, homogenized for 24 hours at 525° C., cut up, scalped to $770\times270$ mm$^2$ in section, heated for 12 hours at 470° C. hot rolled to 3.8 mm (from 460° C.), annealed for 1 hour at 450° C. with a rise and fall in the temperature to +−25° C. per hour (schedule A) or annealed for 1 hour at 450° C., and then quenched in cold water (schedule B), cold-rolled up to 1.6 mm, placed in solution for 20 mm at 528° C., quenched in cold water, flattened, drawn by traction by 2% and tempered for 12 hours at 170° C.

The result of tensile tests in the longitudinal direction and the transverse direction are shown below:

| | A | | B | |
|---|---|---|---|---|
| Schedule Direction | Longitudinal | transverse | Longitudinal | transverse |
| R 0.2 (MPa) | 351 | 363 | 352 | 349 |
| Rm (MPa) | 432 | 468 | 437 | 455 |
| A% of 5.65 $\sqrt{So}$ | 16.5 | 15.0 | 15.4 | 15 |

Figure 6B:
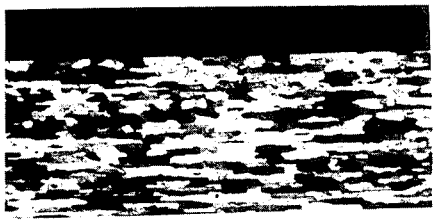
FIG. 6 represents the microstructures obtained according to schedules A and B in example 3.
Figure 6A:
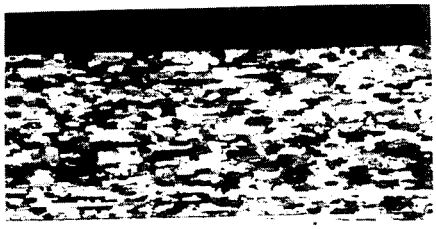

The structures obtained are recrystallized, the crystal size being of the order of 40 μm for schedule A and 40 μm for schedule B (see FIG. 6).

EXAMPLE 4 (according to the invention)

An alloy containing (by weight) 2.5% Li—1.45% Cu—1% Mg—0.05% Fe—0.03% Si—0.05% Zr—0.20% Mn was cast in semi-continuous casting in the shape of a plate measureing $300\times100$ mm$^2$, scalped to 270×70 mm² in section, heated for 6 hours at 470° C., rolled between 460° C. and 300° C. down up to 3.2 mm, annealed for 1 hour at 450° C. (cooled with still air), cold-rolled down to 1.6 mm, placed in solution for 20 minutes at 536° C., quenched in cold water, drawn by traction by 2%, and tempered for 12 hours at 150° C.

The results of tensile tests in the longitudinal direction (L), in the transverse direction (TL), and at 60° to the rolling direction, are shown below:

| Direction | Longitudinal | 60° | Transverse |
|---|---|---|---|
| R 0.2 (MPa) | 376 | 304 | 345 |
| Rm (MPa) | 470 | 436 | 461 |
| A% of $5.65\sqrt{So}$ | 12.7 | 15.1 | 12.0 |

Figure 7:
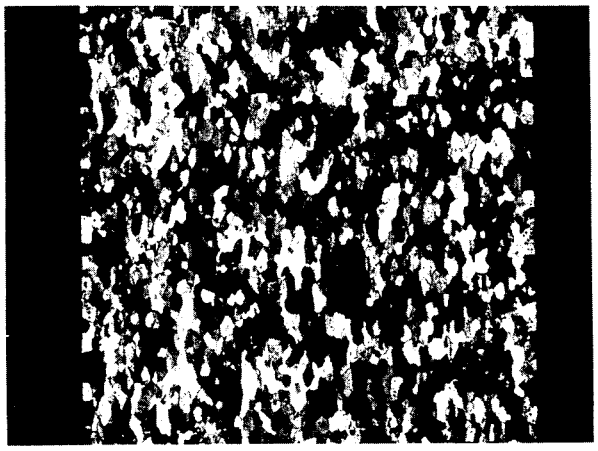
FIG. 7 represents the recrystallized microstructure of a metal sheet relating to example 4.

The structure obtained is recrystallized with a grain size of about 60 μm (see FIG. 7).

TABLE I

Figure 2:
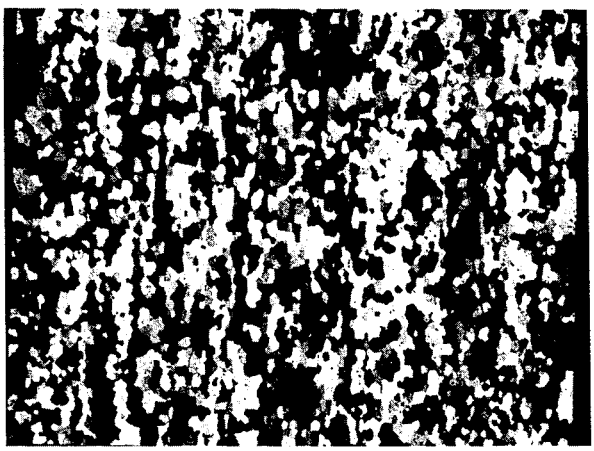
- FIG. 2 represents the microstructure of a recrystallized alloy (casting B, example 1).

| Casting | Tempering | Direction of measuring | R 0.2 (MPa) | Rm (MPa) | A% | Bending radius (++) | deflection Erichsen (mm) | Remarks |
|---|---|---|---|---|---|---|---|---|
| | 12 h at 150° C. | L | 364 | 439 | 4.8 | impossible | 1.5 | Structure not |
| | (under tempering) | 60° | 338 | 469 | 10.1 | — | 1.5 | recrystallized |
| | | TL | 380 | 451 | 3.7 | impossible | | (FIG. 1) |
| | 24 h at 190° C. | L | 451 | 489 | 6.1 | impossible | | Structure not |
| | (maximum | 60° | 435 | 513 | 9.8 | — | 1.5 | recrystallized |
| A | hardening) | TL | 482 | 523 | 3.8 | impossible | | (FIG. 1) |
| | 12 h at 210° C. | L | 440 | 491 | 7.0 | impossible | | Structure not |
| | (oven tempering) | 60° | 415 | 497 | 8.9 | — | 1.2 | recrystallized |
| | | TL | 454 | 505 | 3.8 | impossible | | (FIG. 1) |
| | 24 h at 150° C. | L | 371 | 462 | 13.5 | 2.7 e | | Recrystallized |
| | (under tempering | 60° | 305 | 431 | 14.0 | — | 3.3 | structure (crystal |
| | | TL | 338 | 458 | 10.5 | 3.1 e | | ~50 μm) (FIG. 2) |
| | 24 h at 190° C. | L | 432 | 476 | 5.3 | ≧7 e | | Recrystallized |
| | (maximum | 60° | 390 | 452 | 6.5 | — | 1.5 | structure (FIG. 2) |
| B | hardening) | TL | 420 | 477 | 4.5 | ≧7 e | | |
| | 12 h at 210° C. | L | 406 | 458 | 6.0 | rupture | | Recrystallized |
| | (over tempering) | 60° | 356 | 447 | 7.4 | — | 1.2 | structure (FIG. 2) |
| | | TL | 386 | 458 | 3.9 | rupture | | |

+L: longitudinal direction (rolling direction)
TL: transverse direction (at 90° to the rolling direction)
60°: (at 60° to the rolling direction)
(++) bending 180°
(e = thickness)

What is claimed is:

1. In a method for producing a recrystallized alloy based on Al, consisting essentially of, by weight, 1 to 3.5% Li, up to 4% Cu, up to 5%, up to 3% Zn and additions of Mn, Cr and/or Zr, and comprising the steps of casting, hot working, placing in solution, quenching, and tempering, the improvement comprising forming said alloy from:

Zr≦0.10%
Mn≦0.8%
Cr≦0.20% with $\frac{\%Zr}{0.03} + \frac{\%Mn}{0.3} + \frac{\%Cr}{0.07} > 1.$ and carrying out the tempering at temperatures (T) less than 190° C. and in a region of less than or equal to the isothermal tempering temperature ($T_M$) giving rise to maximum hardness, the period during which the isotherm t(T) is maintained at (T) being less than the period during which the isotherm tm(T) is maintained, which brings about the maximum hardness at said temperature (T).

2. A method according to claim 1, wherein:

for Zr ≦ 0.08%, $\frac{\%Zr}{0.4} + \frac{\%Mn}{0.5} < 1$ for Zr ≧ 0.08%, $\frac{\%Zr}{0.09} + \frac{\%Mn}{3.6} < 1$ and for Zr ≦ 0.09%, Cr < 0.15%.

3. A method according to claim 1 or 2, wherein said temperatures (T) are lower than or equal to $T_M - 15°$ C.

4. A method according to claim 1 or 2, wherein the period t(T) during which said temperatures (T) are maintained, at the time of the tempering, is less than or equal to tm(T)/2.

5. A method according to claim 1 or claim 2, further comprising at least one additional method step which is densifying, stress-relieving, homogenizing, cold working, annealing, or cold stretching.

6. A method according to claim 1 or claim 2, wherein the average crystal size of said recrystallized alloy is less than or equal to 200 μm.

* * * * *